US009302755B2

(12) United States Patent
Wolfe

(10) Patent No.: US 9,302,755 B2
(45) Date of Patent: Apr. 5, 2016

(54) PEDAL PROPULSION DEVICE FOR A WATERCRAFT

(71) Applicant: Bruce A. Wolfe, Spencer, OH (US)

(72) Inventor: Bruce A. Wolfe, Spencer, OH (US)

( * ) Notice: Subject to any disclaimer, the term of this patent is extended or adjusted under 35 U.S.C. 154(b) by 0 days.

(21) Appl. No.: 14/550,078

(22) Filed: Nov. 21, 2014

(65) Prior Publication Data

US 2015/0166158 A1 Jun. 18, 2015

Related U.S. Application Data

(60) Provisional application No. 61/913,356, filed on Dec. 8, 2013.

(51) Int. Cl.

| | |
|---|---|
| ***B63H 16/20*** | (2006.01) |
| *B63H 25/06* | (2006.01) |
| *B63H 16/18* | (2006.01) |

(52) U.S. Cl.

CPC ..... *B63H 16/20* (2013.01); *B63H 25/06* (2013.01); *B63H 2016/185* (2013.01); *B63H 2016/202* (2013.01)

(58) Field of Classification Search

CPC .. B63H 16/20; B63H 25/06; B63H 2016/185; B63H 2016/202

USPC ..... 440/26, 27, 28, 29, 30

See application file for complete search history.

(56) References Cited

U.S. PATENT DOCUMENTS

| | | | | |
|---|---|---|---|---|
| 1,761,884 | A * | 6/1930 | Gorski | B63H 16/14 440/30 |
| 4,427,392 | A * | 1/1984 | Schneider | B63H 16/14 440/30 |
| 5,217,398 | A * | 6/1993 | Meron | B63H 16/14 440/21 |
| 5,282,762 | A * | 2/1994 | Cerreto | B63H 16/14 440/30 |
| 5,413,066 | A | 5/1995 | Spencer, Jr. et al. | |
| 5,460,551 | A * | 10/1995 | Beres | B63H 16/14 114/347 |
| 6,905,379 | B1 * | 6/2005 | Jackson | B63H 16/20 440/30 |
| 7,530,867 | B2 | 5/2009 | Jackson | |
| 8,342,897 | B2 | 1/2013 | Gater et al. | |

* cited by examiner

*Primary Examiner* — Anthony Wiest
(74) *Attorney, Agent, or Firm* — Harpman & Harpman

(57) ABSTRACT

A pedal propulsion device for use on a small watercraft, having a lightweight portable frame with integral foot-engagement cranks. A propeller and rudder assembly driven by the foot cranks automatically will adjust for obstacles within and below the water, while maintaining direct drive by utilizing a depth stabilizer assembly extending from the support frame.

7 Claims, 5 Drawing Sheets

PEDAL PROPULSION DEVICE FOR A WATERCRAFT

This application claims the benefit of U.S. Provisional Application No. 61/913,356, filed Dec. 8, 2013.

BACKGROUND OF THE INVENTION

1. Technical Field

The primary way to propel and control small unpowered watercraft is with paddles or oar. These devices use the arms and upper body to do the heavy work of propelling a boat through the water, as well as controlling the direction of the craft. The more appropriate members of the body for locomotion are the legs, which are stronger and process greater endurance.

Both paddles and oars require skill and practice to use and can be frustrating and confusing to try to put to use efficiently, especially for beginners. Both are not very intuitive in operation. Paddling requires switching from side to side to keep a straight track, and even so may still result in a very zigzag course.

Rowing also has other drawbacks, such as the user must sit backwards to the direction of travel and must look over the shoulder or the corner of their eye to see where he is going.

This invention relates to specifically to a pedal propulsion system for powering small lightweight watercraft. The system has a portable support frame, which is easily adaptable and provides for integrated pedal powering mechanism to drive and steer the craft.

2. Description of Prior Art

Prior art devices of this nature can be seen for example in U.S. Pat. Nos. 5,413,066, 7,530,867 B2, and 8,342,897 B2.

In U.S. Pat. No. 5,413,066, a pedal powered pond boat can be seen having propulsion systems with a set of pedals that drives a propeller assembly, which can move up upon contact with an obstacle in the water.

U.S. Pat. No. 7,530,867 is directed to a portable canoe propulsion system having a pedal powered crank and gear box for a propeller on a driveshaft that can be moved from a operable position to a non-operable position.

Finally, in U.S. Pat. No. 8,342,897 a pedal propulsion system is claimed having a pedal driven crankshaft and propeller in communication therewith.

SUMMARY OF THE INVENTION

Figure 1:
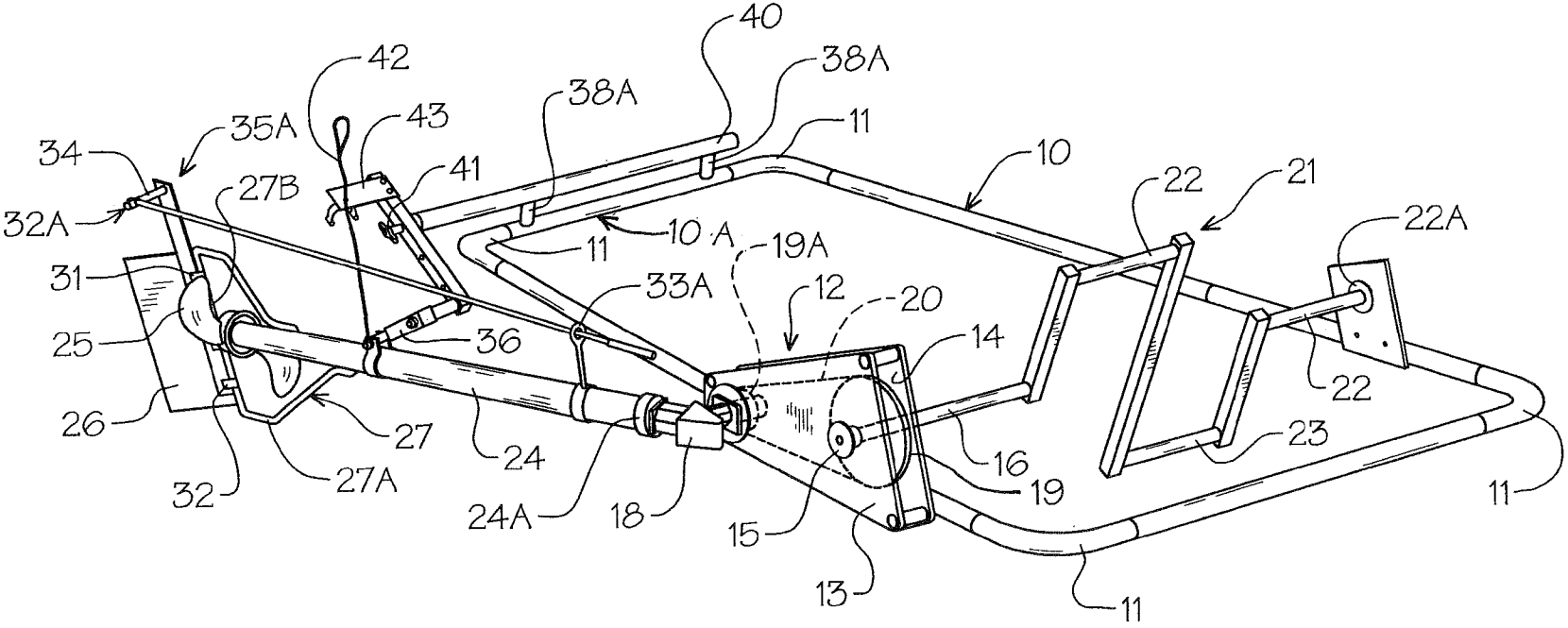
FIG. 1 is a perspective view of the pedal prop of the invention.

The pedal prop is an add-on device for small unpowered watercraft, both rigid and inflatable, such as kayaks, canoes, Jon boats and dinghies, that enables the user to pedal to power a propeller for propulsion with an integral rudder for directional control rather than using paddle or oars.

DESCRIPTION OF THE PREFERRED EMBODIMENT

The pedal prop of the invention is composed of multiple primary components: frame, chain box, pedal input crank assembly and drive tube.

A frame 10 is rectangular in form and can be made of several different materials, including aluminum tubing being one of the best. Square, rectangular or round tubing can be fabricated into the frame 10 by using any number of ways to fasten the tubing together at the corners. Bolt gussets, 'L' brackets 11 or some other right angle tube connector can be used to form the corners. Bending the tubing to a right angle is also possible.

A chain box 12 is composed of two plates, the outside plate 13 and an inside plate 14 of the same size and position in spaced opposition to one another. The plates are bolted together with appropriate spacers to set the distance between them. Each of the plates 13 and 14 has an opening A to accommodate flange bearings 15 for a crankshaft 16 that runs through both plates perpendicular thereto. The crankshaft 16 has a roller chain sprocket 19 secured thereto between the respective plates 13 and 14.

A pedal input crank assembly 21 extends from the crankshaft 16 having two oppositely disposed spaced offset foot engagement cranks 22 and 23 on a support shaft rotatably secured to the frame 10 by a bearing fitting 22A, as will be understood by those skilled in the art, and best seen in FIG. 1 of the drawings.

Figure 2:
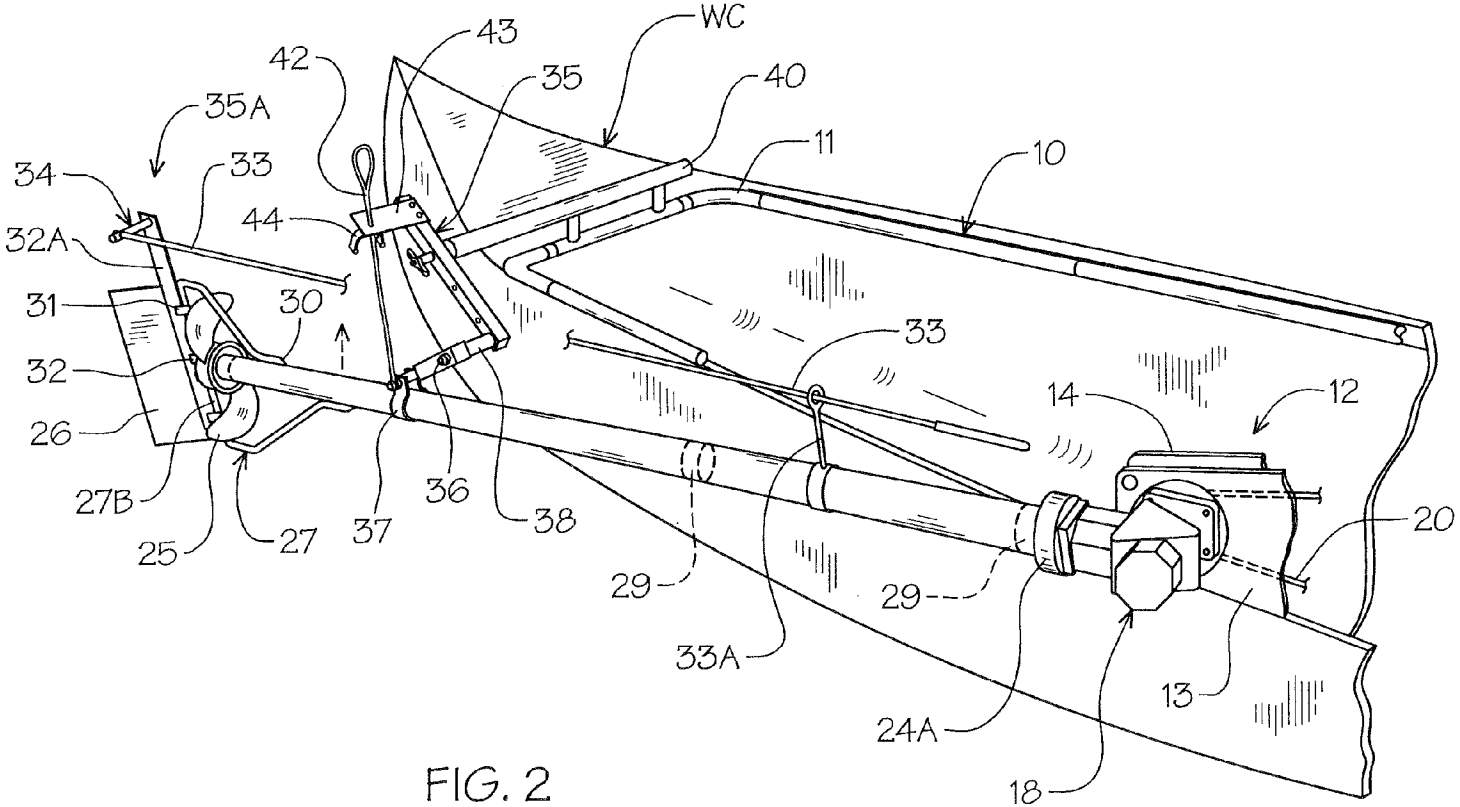
FIG. 2 is an enlarged partial perspective view thereof.

A small right angled gear box 18 is mounted to the outside plate 13 of the chain box 12. The gear box 18 will not be rigidly attached but able to rotate 360 degrees around the input shaft which is perpendicular to the plates. An output shaft 18A of the gear box 18 is parallel with the plates 13 and 14 and outside the chain box 12, as best seen in FIG. 2 of the drawings. A second opening outside plate 13, which has a diameter that matches the outside edge of a bolt hole pattern within the input face of the gear box 18. It will be seen that when bolts B are placed in the input face of the gear box 18, the gear box can rotate through 360 degrees. To prevent the gear box from coming in contact with the plate, a thin stainless steel fender washer W which is of a slightly larger diameter than that of the aperture A2 is positioned between the gear box 18.

The washer's W center hole C accommodates the input shaft of the gear box and the bolt hold pattern for the gear box 18 is transferred to the washer W, and the clearance holes are drilled in the fender washer W for the mounting bolts B for the gear box 18. A second fender washer W2 is identical to the first and is placed on the other side of the outside plate 13 between the respective inside and outside plates 14 and 13, and the mounting bolts B are passed through the clearance holes of the washer WA through spacers S which are the same thickness as the outside plate 13 (one on each bolt) through the opening A2 in the plate 13, through the clearance holes of the washers W and secured into the input face of the gear box 18. The bolts B are tightened enough to press both the washers WA and W2 on the opposite sides of the respective outside plate 13, but the spacers between the washers prevent overtightening, which would prevent the gear box 18 from rotating. It will be evident that this arrangement allows the gear box 18 to rotate, as will be required during use and discussed and described in greater detail hereinafter.

A second smaller roller chain sprocket 19A shown in broken lines in FIG. 1 of the drawings, is mounted on the input shaft of the gear box 18. A roller chain 20 connects the two roller chains sprockets 19 and 19A transferring rotational output of the crank assembly 21 to the input shaft of the gear box 18, as will be well understood by those skilled in the art.

Referring now to FIGS. 1 and 2 of the drawings, a drive tube 24 can be seen, which is used to transfer rotational gear box 18 power output to a propeller 25 at the end of the drive tube 24, which also supports a rudder 26 which steers the watercraft WC and a propeller guard 27 which also protects the rudder 26. The drive tube 24 is attached to the output end of the gear box 18, utilizing a two-piece clamp-on shaft collar 24A which has been bolted to the output side of the gear box 18.

A drive shaft 28 is accordingly supported inside the drive tube 24 by custom-made delrin (plastic) bushings 29 therein at each end of the drive tube 24 and one in the center. The bushings 29 are held in position in the drive tube 24 by a fastener passing through the wall of the drive tube 24 and into the respective bushings 29, shown in broken lines in FIG. 2 of the drawings.

Figure 5:
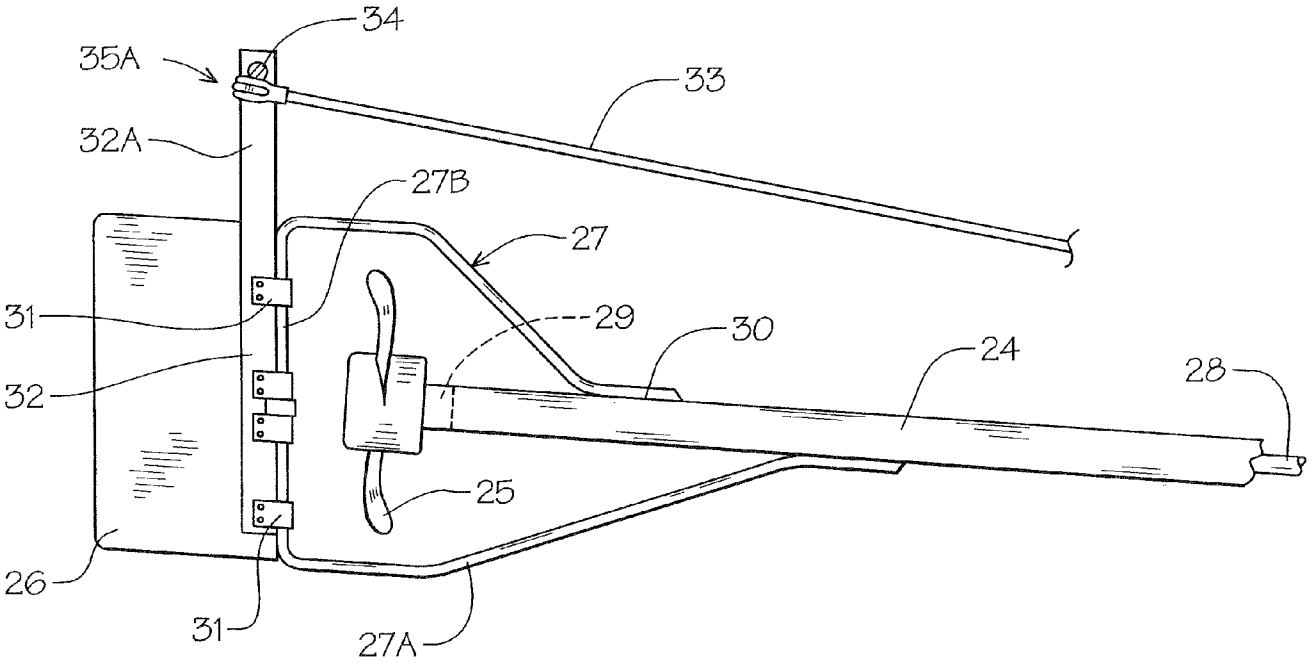
FIG. 5 is an enlarged partial side elevational view of the rudder guard and propeller.

The drive tube 24 (as noted) supports propeller guard 27 as best seen in FIG. 5 of the drawings, which is formed from a thin aluminum rod bent into a compound shape. A rod bottom 27A of the guard 27 has a gentle slope going from a forward point on the drive tube 24 towards the propeller 25, so it will easily ride over obstacles (not shown) and protect the propeller 25. The guard 27 then goes under the propeller 25 and bends upwardly to go vertically at 27B just behind the propeller 25. Once the guard is above the top of the propeller 25, it is bent over the top and then bends downwardly until it reaches the top of the drive tube 24 where it is parallel to the drive tube so it can be fastened to the drive tube 24 at 30.

The rudder 26 is constructed of suitable material like polycarbonate (plastic) sheet and is positioned to the rear of the propeller 25 on the vertical section of the propeller guard 27B.

The rudder 26 is moveably secured to the propeller guard section 27B by a plurality of vertically spaced hinge brackets 31, pivotally extending around the guard section 27B and secured to a rudder bar 32 along the rudder edge and extending upwardly there beyond at 32A.

A tiller rod 33 is pivotally attached to the upper bar portion 32A by a threaded spacer 34 and an interior linking eyelet in cleves assembly 35A positioned thereon.

It will be seen that the tiller rod 33 extends forward through a guide fitting 33A on the drive tube 24 as best seen in FIG. 2 of the drawings, so as to position the free end of the tiller rod 33 for engagement by a user as would be positioned (not shown) in the watercraft WC.

Figure 3:
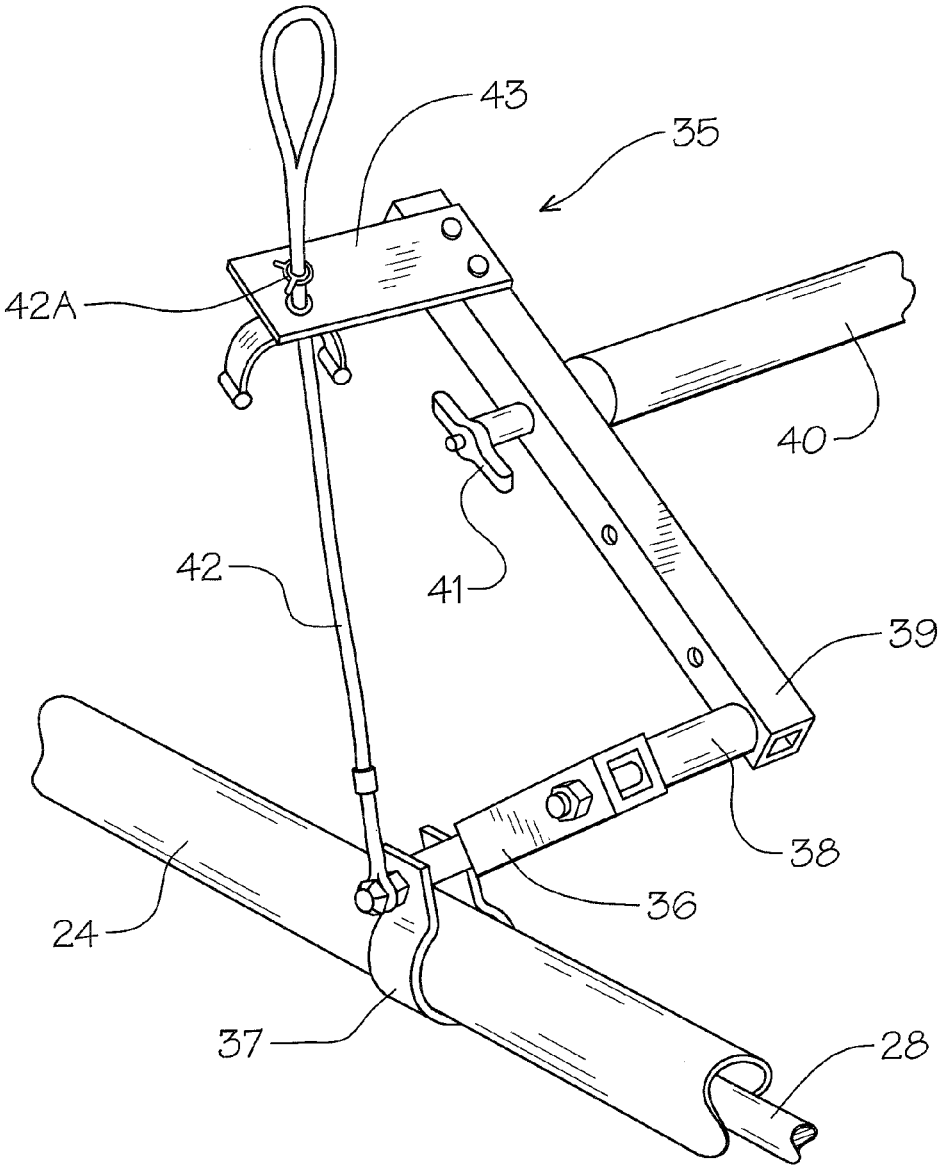
FIG. 3 is an enlarged partial perspective view of a depth setter stabilizer assembly of the invention.
Figure 4:
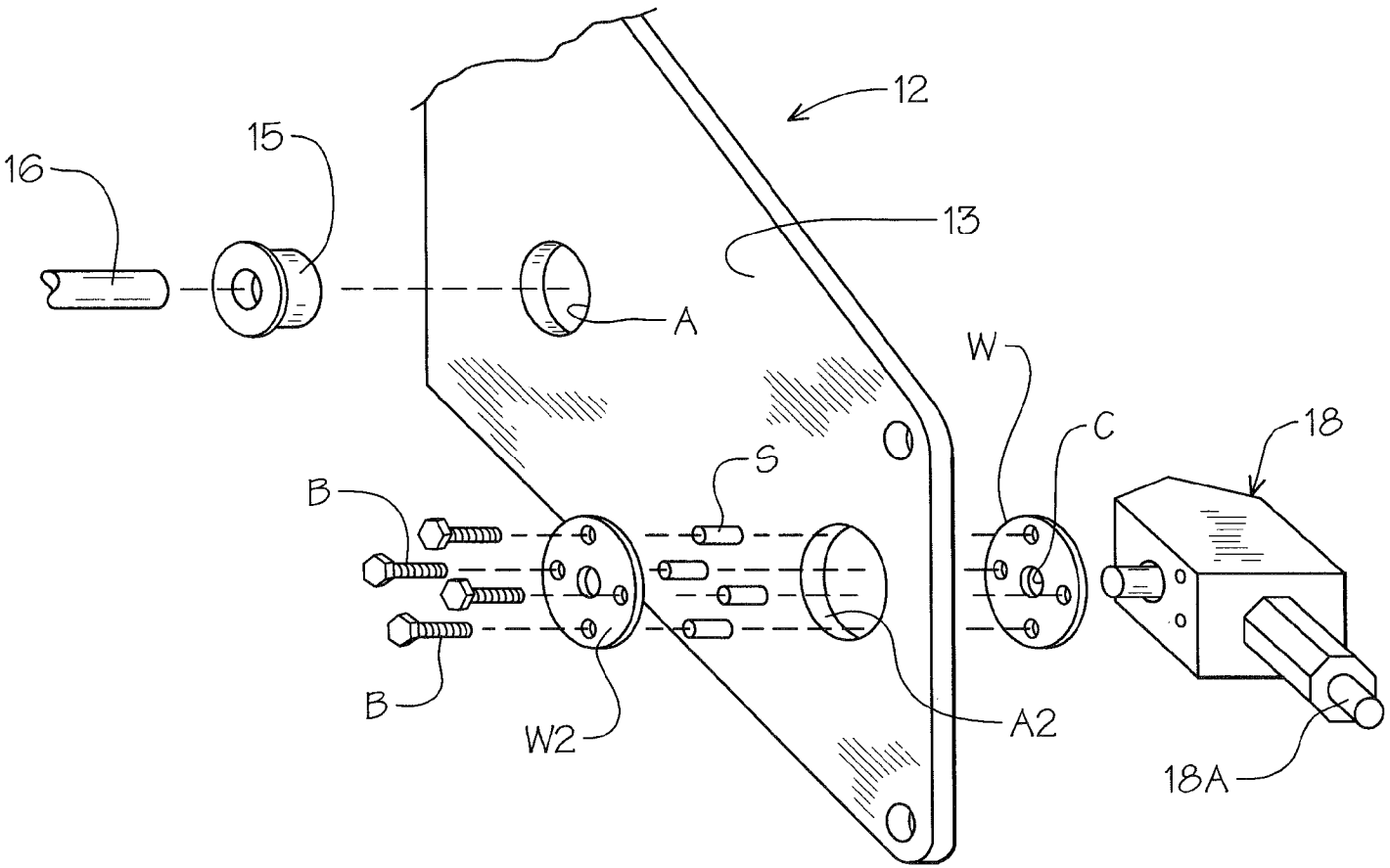
FIG. 4 is an exploded perspective view of the gear box and mount of the invention.

Referring now to FIGS. 1, 2 and 3 of the drawings, a depth stabilizer assembly 35 can be seen, which controls and limits the maximum vertical travel of the drive tube 24 and attached rudder 26 and propeller guard 27, when encountering an object in the water, as well as providing manual repositioning thereof. A control tube 36 is pivotally secured at one end to the drive tube 24 by a clamp 37 and it is oppositely disposed end by a spacer linkage 38 to an adjustable arm 39, which in turn is adjustably secured to the end of a support bracket 40 extending at right angles therefrom by a T-handled fitting 41, as best seen in FIG. 3 of the drawing.

An adjustable cord 42 extends from the clamp 37 up through a mounting plate 43 secured to and extending from the free end of the arm 39 which sets the operating depth of the depth setter stabilizer by a cord clip 42A. A drive tube retainment clip 44 is positioned on the end of the plate 43, which allows for manual raising and retaining of the drive tube 24 in the retaining clip 44 utilizing the cord 42, if and when required.

The support frame bracket 40 extends in space parallel alignment along the end portion of the support frame 10 and is secured thereto by fasteners and spacers assemblies 38A, as will be understood by those skilled in the art.

In operation, the pedal prop of the invention is positioned within a suitable watercraft WC as seen partially in FIGS. 1 and 2 of the drawings, with the end portion 10A of the support frame 10 being positioned just in back where a seat (not shown) would be with the crank assembly 21 in space relation thereto in the intended direction of travel.

The drive tube 24 will therefore be outside of the watercraft along side in parallel offset relation to its center axis.

It will therefore be seen that the depth of the propeller 25 in the water is determined by the depth stabilizer assembly 35, which limits the travel of the drive tube 24, as herein before described. It will be evident therefore that once an object in the water (not shown) is engaged by the propeller guard 27, that the drive tube 24 and its integrated attached rudder 26 and propeller 25 will be effectively move upwardly in a controlled stabilized manner by the depth stabilizer assembly 35, with the gear box 18 being able to effectively pivot within its mounting configuration as described above. Once the object has passed, then the drive tube 24 and its integrated effective elements will automatically drop down re-engaging the propeller 25, and more importantly thereby effectively protecting the rudder 26 and propeller 25 assemblies from damage.

It will also be seen that the use of the tiller rod 33 provides for safe and effective movement of the rudder 26 remotely within the integrated propulsion and directional input assembly as described.

As noted in use, the operator (not shown) sits down with his or her back against the back member of the frame 10A and their feet on the crank assembly 21 foot engagement cranks 22 and 23 and by peddling causes the propeller 25 to rotate and propel the watercraft WC. The direction of control is achieved by controlling the rudder with the tiller rod 33 as noted. By peddling backwards, the watercraft WC can effectively go in reverse. The propeller guard 27 protects the propeller 25 and the rudder 26 from underwater obstacles and because of the hereinbefore mounting of the gear box 18, the drive tube and its supported elements rises up and pass over obstacles and returns to its operational depth as set by cord 42. The watercraft WC can also be beached without any manual action by raising the drive tube and the propeller 30 to avoid damage to it.

It will thus be seen that a new and novel pedal prop assembly has been illustrated and described, and it will be apparent to those skilled in the art that various changes and modifications may be made thereto without departing from the spirit of the invention.

Therefore I claim:

1. A pedal propulsion device for small watercraft comprising, a support frame selectively positioned within in said watercraft, a pedal crank assembly on said support frame, said pedal crank assembly including a rotatable crankshaft, a gear box rotatably mounted on a chain box in communication with said pedal crank assembly, a drive tube extending from said gear box, a drive shaft within said drive tube in communication with an output shaft of said gear box, a propeller on a free end of said drive shaft, a propeller guard extending from said drive tube, a rudder assembly on said propeller guard, a depth stabilizer assembly on said support frame in adjustable communication with said support frame comprising, a control tube pivotally secured between said drive tube and an adjustable arm extending from said support frame, an adjustable cord on said depth stabilizer assembly to set operating depth, means for manually retaining said drive tube and rudder to said support frame.

2. The pedal propulsion device set forth in claim 1 wherein said pedal crank assembly comprises, foot engagement cranks on the rotatable crankshaft, a drive sprocket on said crankshaft located within said chain box.

3. The pedal propulsion device set forth in claim 2 wherein said chain box has a second sprocket and a roller chain engaging said second sprocket and said drive sprocket.

4. The pedal propulsion device set forth in claim 1 wherein said drive tube, propeller and rudder are moveable from a first engaged propulsion position to a second non-engaged propulsion position.

5. The pedal propulsion device set forth in claim 1 wherein said means for retaining said drive tube comprises a retainment clip on said depth stabilizer assembly.

6. The pedal propulsion device set forth in claim 1 wherein said propeller guard extends about said propeller and supports said rudder assembly.

7. The pedal propulsion device for small watercraft set forth in claim 1 wherein said support frame is formed of tubular material.

* * * * *